United States Patent [19]

Zankl

[11] 3,947,798

[45] Mar. 30, 1976

[54] RE-USABLE ELECTRICAL FUSE

[76] Inventor: Robert H. Zankl, 10735 SW. 58th Ave., Miami, Fla. 33173

[22] Filed: Mar. 5, 1975

[21] Appl. No.: 555,563

[52] U.S. Cl. ..... 337/228; 337/402

[51] Int. Cl.[2] ..... H01H 85/22

[58] Field of Search ..... 337/167, 228, 230, 237, 337/402, 403, 404, 405

[56] References Cited

UNITED STATES PATENTS

| | | | |
|---|---|---|---|
| 1,464,902 | 8/1923 | Feldkamp | 337/228 |
| 1,482,032 | 1/1924 | Pawlik et al. | 337/402 |

*Primary Examiner*—Harold Broome

*Attorney, Agent, or Firm*—Ernest H. Schmidt

[57] ABSTRACT

A re-usable electrical fuse having an elongaged, non-electrically conductive, normally vertically extending capsule and a pair of electrical switch contacts extending inwardly of the capsule at each end thereof, the upper pair of contacts being normally close-circuited by a charge of fusable metal within the capsule and adapted to open circuit and close-circuit the lower pair of contacts by gravity action upon melting of the fusable metal charge due to a current overload being imposed upon an electrical circuit to be fuse-protected in series connection with the upper pair of electrical switch contacts, thereby permitting the re-use of the fuse by rotating the capsule through 180 circular degrees so that the now close-circuited lower pair of electrical switch contacts is in the upper position and in series circuit connection with the protected circuit.

8 Claims, 5 Drawing Figures

RE-USABLE ELECTRICAL FUSE

This invention relates to electrical fuses and is directed particularly to an electrical circuit-breaking fuse that is re-usable indefinitely simply by change from one position to the other of two opposed positions after "burn-out" due to current overload in the associated electrical circuit.

The use of fusable high resistance metal elements as circuit-breaking devices protecting against electrical circuit overload is well known. Heretofore, such electrical fuses have commonly been manufactured in the form of screw plugs or electrode-capped, cylinrical cartridges receivable in appropriate receptacles in fuse boxes and the like for series-connection in branch electrical circuits to be protected. Such fuses, particularly such cartridge fuses that have heretofore been devised were usable only once, since "burn-out" of the fusable element therein permanently open-circuited the fuse.

While plug type fuses having a small plurality of fusable elements which could be successively switched in the plug fuse circuit after each burn-out have been devised, they have been found to be generally unsatisfactory and fallen into disuse. It is, accordingly, the principal object of this invention to provide a novel and improved electrical circuit-breaking fuse that is re-usable indefinitely simply by changing its position back and forth between two opposed operative positions, selectively, in the associated fuse box or fuse receptacle each time a burn-out due to circuit overload occurs.

A more particular object of the invention is to provide a re-usable electrical fuse of above nature wherein the fusable element is in the form of a charge or globule of high-resistance, low melting temperature metal incapsulated in an elongated capsule having a pair of fuse circuit switch electrodes projecting inwardly thereof at each end for electrical short circuiting by the solidified fusable metal globule when disposed at the corresponding end of the capsule, and being adapted to fall by gravity to the other end of the capsule for open-circuiting the first pair of electrodes and close-circuiting the other pair of electrodes at the lower end of the capsule upon melting thereof upon circuit overload, whereby, after such open circuiting, the fuse device can be replaced so that its now closed-circuited switch contacts are connected in the circuit to be protected until such time as the next overload and consequent circuit breaking occurs, etc.

Yet another object of the invention provides a re-usable fuse of the above nature including a housing and rotary switching means carrying the incapsulated fusable element, and so arranged as to switch the alternate switch contact pairs in the fuse circuit as the rotary member is turned 180 circular degrees after each fuse burn-out to re-establish fuse protection.

Yet another object of the invention is to provide a re-usable electrical fuse device of the character described and in the form of a cylindrical cartridge wherein fuse renewal is accomplished by simply reinserting the cartridge after rotating it through 180 circular degrees end-for-end in its vertical position in the cartridge receptacle.

Yet another object of the invention is to provide a re-usable electrical fuse of the character described which will be simple in construction, compact in form, inexpensive to manufacture, dependable in operation and durable in use.

Other objects, features and advantages of the invention will be apparent from the following description when read with reference to the company drawings. In the drawings, wherein like reference numerals denote corresponding parts throughout the several views.

Figure 1:
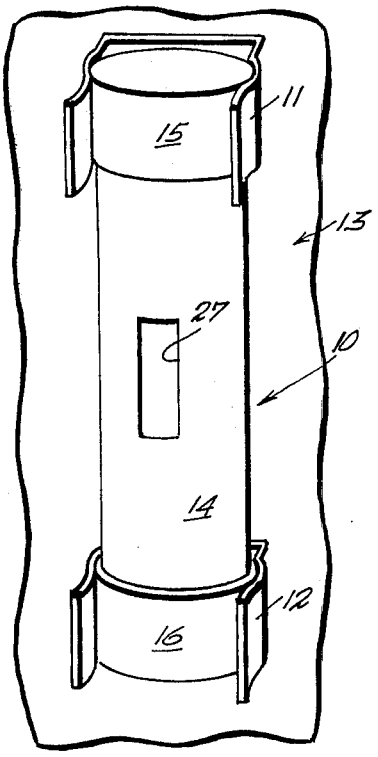
FIG. 1 is an oblique elevational view of a cartridge type re-usable fuse embodying the invention, shown fitted for use between typical electrical contact receptacle members.
Figure 2:
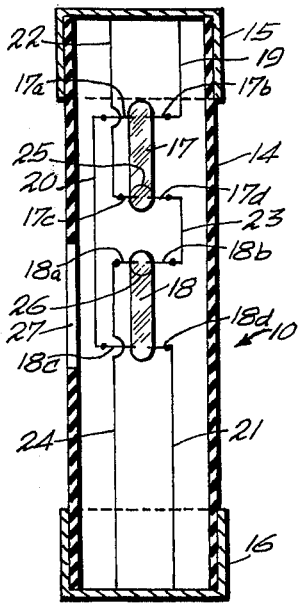
FIG. 2 is a longitudinal cross-sectional view of the cartridge type re-usable fuse illustrated in FIG. 1, shown separately, and illustrating details of the internal circuitry.
Figure 3:
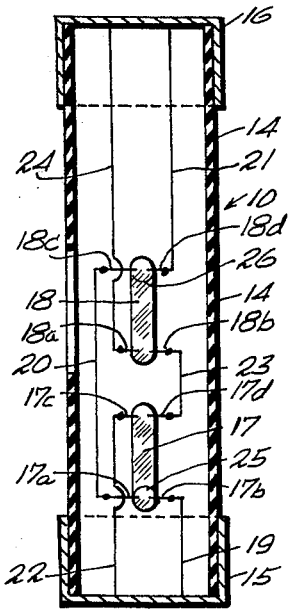
FIG. 3 is a vertical cross-sectional view similar to that of FIG. 2 but in an inverted position, and illustrating operation of the circuitry to re-establish fuse protection after a "burn-out" effected while the fuse device is used in the relatively inverted position of FIG. 1.

Referring now in detail to the drawings, reference numeral 10 designates, generally, a cartridge type re-usable fuse embodying the invention, the same being illustrated in FIG. 1 as inserted for use between contact receptacles 11, 12, which are typically mounted in a fuse box 13 (partially illustrated) enclosing the circuitry for the electrical branch circuit, or the like, in which the fuse is connected by means of said receptacles. As illustrated in FIGS. 2 and 3, the cartridge type re-usable fuse 10 comprises a non-electrically conductive tubular housing member 14 capped at each end with cylindrical metal contact or terminal members 15 and 16.

The housing member 14 contains a first elongated switching capsule 17 and a second elongated switching capsule 18 which are of a non-electrically conductive material such as high temperature resistant glass, for example. Each of the elongated switching capsules 17, 18 has embedded in each end thereof a pair of electrical switch contact members 17*a*, 17*b;* 17*c*, 17*d* and 18*a*, 18*b;* 18*c*, 18*d*, respectively. The inner or interior ends of these switch contact member pairs are slightly spaced from one another to be shunted or electrically closed from time to time in the manner and for the purposes hereinafter more particularly described.

As best illustrated in FIG. 2, the switch contact members 17*a*, 17*b* and 18*c*, 18*d*, are connected in series between the terminal contact members 15 and 16 of the cartridge re-usable fuse 10 by means of electrical conductors 19, 20 and 21. Similarly, the electrical switch contact members 17*c*, 17*d* of the first elongated switching capsule 17 and the electrical switch contact members 18*a*, 18*b* of the second elongated switching capsule 18 are connected in series with said terminal contact members by means of electrical conductors 22, 23 and 24.

The elongated switching capsule 17 contains a charge of metallic mercury 25 which, being liquid at ordinary temperatures will always fall to the bottom of its container to close-circuit the switch contact pairs thereat, i.e. the switch contact members 17*c*, 17*d* as illustrated in FIG. 2.

The elongated switching capsule 18 contains a small charge of a high-resistance, low melting temperature metal 26 such as woodsmetal, serving as a fusable element in breaking the fuse circuit upon current overload. This charge or globule of fusable metal will be disposed in switch-shorting relation either at the upper or lower end of its capsule depending upon the condition of the fuse, as is hereinbelow more particularly explained.

Considering now the operation of the re-usable cartridge fuse 10 and referring first to FIG. 2, it will be seen that a circuit is established through the fuse between the terminal cap members 15, 16 by conductor 22, now closed switch contact members 17*c*, 17*d* through mercury charge 25, conductor 23, now closed-circuited electrical switch contact pair 18*a*, 18*b*, through fusable metal charge 26 and conductor 24. After the fuse is placed in service as illustrated in FIG. 1 in a vertical position as illustrated in FIG. 2, it serves to energize the associated electrical branch circuit. If an overload should occur in this circuit, the resulting increase in current flowing through the charge of fusable metal 26 in the series circuit as described above, would instantly fuse or melt this charge of metal whereupon it will drop and solidify at the lower end of its capsule 18 to close-circuit switch contact member pair 18*c*, 18*d*. Since this closed switch is in series with now open switch contact pair 17*a*, 17*b* associated with mercury charge capsule 17, as described above, the circuit through the re-usable cartridge fuse 10 will remain open circuited, so as to denergize the associated branch circuit. To re-use the cartridge fuse 10, it is only necessary to remove it from its vertical position in its receptacle and rotate it 180° end for end, as illustrated in FIG. 3, whereupon, after re-insertion in a branch circuit receptacle or the like, it will again serve as an operative, closed-circuit fuse. In this instance, as illustrated in FIG. 3, the fusable circuit now extends between terminal end caps 15 and 16 through conductor 19, now closed switch terminal contact pairs 17*a*, 17*b*, electrical conductor 20, now closed electrical switch contact pairs 18*c*, 18*d* and electrical conductor 21. Thus, to whichever end the charge of fusable metal 26 falls in its capsule 18 upon fuse "burn-out," a fusable circuit can again being re-established for re-use of the fuse simply by turning it end-for-end in a vertical position. It will be understood of course that the "size" or amperage at which the fuse operates or open circuits can readily be controlled by the particular alloy and/or size of the charge of fusable metal 26 used in its capsule 18.

Preferably, the fusable metal charge capsule 18 will be disposed for viewing through a central elongated opening 27 in the cylindrical housing member 14 whereby it can be readily determined if the fuse has open-circuited or "blown" due to circuit overload. In this connection it will be noted that if the fusable metal charge is in its upper end position within its associated transparent capsule 18, the fuse is in operating condition, whereas if it has melted and fallen to the bottom position, the fuse can readily be observed to be in non-operative of burn-out condition, whereupon, as hereinabove described, it can be re-used simply by turning it end-for-end so that the fusable metal appears to be at the upper end of its capsule enclosure.

Figure 4:
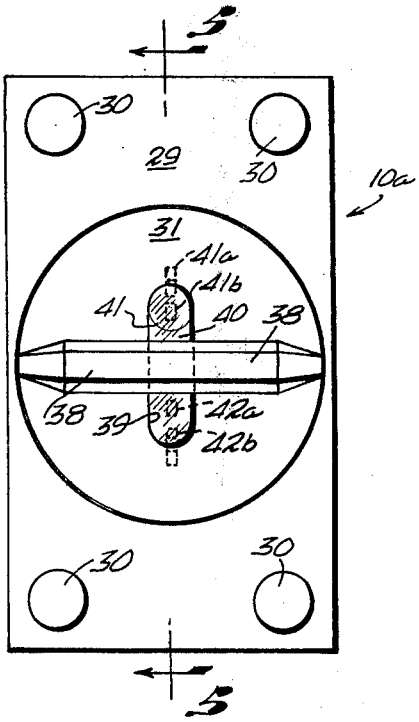
FIG. 4 illustrates, in front elevation, a modification of the invention wherein fuse renewal is effected simply by manually turning a rotary member between 180 circular degrees opposed positions of use.
Figure 5:
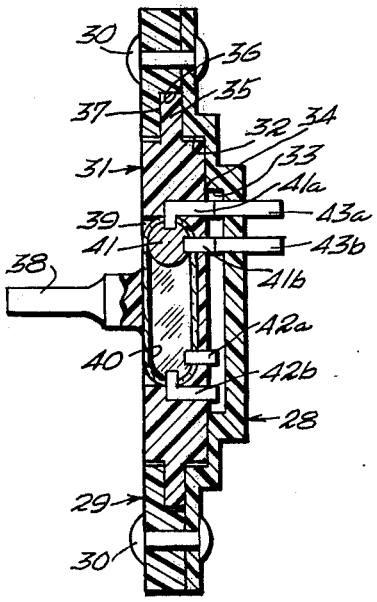
FIG. 5 is a longitudinal cross-sectional view taken along the line 5—5 of FIG. 4 in the direction of the arrows.

FIGS. 4 and 5 illustrate an alternative form of re-usable fuse embodying the invention which is adapted to permanent plug-in connection into an appropriate receptacle in an electrical branch circuit fuse box, for example, and wherein renewal after fuse "blow-out" is effected simply by rotating in a rotary member comprising the device through 180 circular degrees.

The renewable fuse device of FIGS. 4 and 5, designated generally by reference numeral 10*a*, comprises a rectangular back plate 28 molded of an non-electrically conductive material such as a tough synthetic plastic, a rectangular front plate 29 of the same material and peripheral size secured against said back plate as by corner rivets 30, and a rotary member 31 extending centrally through said front cover plate and constrained to rotary motion with respect to said assembled front and back plates as is hereinafter more particularly described.

The inside of the back plate 28 is formed with a first circular recess 32 and a second, coaxial circular recess 33 of somewhat decreased diameter. The annular shoulder 34 defined by the recesses 32 and 33 serve as an abutment slide surface against which the rotary member 31 rotates. The rotary member 31 comprises an integrally formed, central, peripheral flange portion 35 constrained for sliding rotary motion in an annular slot 36 defined by a peripheral coaxial recess 37 formed at the inside of the rotary member 31. The rotary member 31, at the outside, is integrally formed with a horizontal, diametrically-extending handle 38 by means of which said rotary member may be turned into reverse position for renewal of the fuse in the manner hereinbelow more particularly described.

The front face of the rotary member 31 is provided with a vertically-extending opening 39 within which is disposed an elongated capsule of high temperature resistant glass, for example, identified by reference numeral 40, which contains, at the upper end thereof as illustrated in the drawings, a charge of fusable, low melting temperature metal 41 having high electrical resistance, such as a woodsmetal alloy, for example.

Extending through the glass capsule 40 at each end thereof are respective pairs of electrical contact members 41*a*, 41*b* and 42*a*, 42*b*, respectively, the outer ends of which extend outwardly of the back surface of the rotary member 31 and terminate in a common plane parallel with said back surface. As illustrated in FIGS. 4 and 5, when the rotary member 31 is in the rotative position as illustrated in FIGS. 4 and 5 of the drawings, the electrical contact members 41*a*, 41*b* are in brush contact with respective switch terminal plug members 43*a*, 43*b*, respectively, thereby establishing through circuit connection with the charge of fusable low melting temperature 41 which, when in the upper position as illustrated in the drawings, completes a circuit through said switch terminal plug members.

In use of the rotary fuse device 10*a*, it is installed in position in the fuse box having an appropriate receptacle for connection with the switch terminal plug members 43*a*, 43*b*, thereby placing the device in series connection with an associated electrical branch circuit to be protected against overload. Should an overload occur, the fusable metal charge 41 comprising the fuse circuit will be heated to molten temperature, whereupon it will fall by gravity to the lower end of its capsule 40 to internally shunt the electrical contact members 42*a*, 42*b*, whereat it will solidify. It will be noted that such operation or blow-out of the fuse can readily be observed at the front of the rotary member 31 whereupon, as soon as the fault resulting in the blow-out in the circuit has been corrected, fuse protection can be reinstated simply by turning the rotary handle 38 through 180° so that the now electrically shunted electrical contact members 42*a*, 42*b* will be in series with the fuse switch terminal plug members 43*a*, 43*b* to re-establish continuity in the branch circuit protected.

While I have illustrated and described herein only two forms in which my invention can conveniently be embodied in practice, it is to be understood that these forms are presented by way of example only and not in a limiting sense. The invention, in brief, comprises all the embodiments and modifications coming within the scope and spirit of the following claims.

What I claim as new and desire to secure by Letters Patent is:

1. A re-usable electrical fuse comprising, in combination, an elongated, non-electrically conductive, normally vertically-extending, transparent hollow capsule of high temperature resistant glass, a first pair of electrical switch contacts extending inwardly of said capsule at one end thereof, a second pair of electrical switch contacts extending inwardly of said capsule at the other end thereof, a charge of fusable metal within said capsule and normally disposed within the upper end portion thereof and in close-circuiting relation with respect to said first pair of electrical switch contacts, a first fuse circuit connector means in series with said first pair of electrical switch contacts, and a second fuse circuit connector means in series with said second pair of electrical switch contacts, whereby, upon a current overload occurring in an electrical load circuit connected in series with said first fuse circuit connector means, said charge of fusable metal will be brought to molten temperature to fall by gravity into the lower end portion of said capsule to solidify in close-circuiting relation with respect to said second pair of electrical switch contacts while at the same time open-circuiting said first pair of electrical switch contacts, as will be readily observable upon visual inspection of said capsule, whereupon said re-usable electrical fuse can be re-used simply by rotating it through 180 degrees end-for-end in a second normal position and connecting the electrical load circuit in series with said second pair of electrical switch contacts.

2. A re-usable electrical fuse as defined in claim 1, and further comprising a non-conductive back plate, a non-conductive, circular front plate carried in face-to-face relation with respect to said back plate, means constraining said front plate to rotary motion about its rotary axis and with respect to said back plate, said capsule being centrally affixed with respect to the front of said front plate with its longitudinal axis substantially parallel with said back face of said front plate, a pair of electrically conductive switch terminal plug members extending through said back plate and being adapted for plug-in connection with a fuse circuit receptacle, said first and second fuse circuit connector means each comprising a pair of electrical contact members extending outwardly of the rear of said back plate and being so positioned as to make electrical brush contact, selectively, with said pair of electrical plug members as said front plate is rotated through 180 circular degrees with respect to said back plate.

3. A re-usable electrical fuse as defined in claim 2, and further comprising a diametrically-extending handle at the front of said front plate for manually rotatively turning said front plate with respect to said back plate.

4. A re-usable electrical fuse as defined in claim 3, wherein said handle extends perpendicularly with respect to the longitudinal axis of said capsule and in overlying relation with respect to a central portion of said capsule, whereby end portions of said capsule will remain visible for determining the end position of said charge of fusable metal therein.

5. A re-usable electrical fuse as defined in claim 1, including means for automatically connecting the electrical load circuit in series with said second pair of electrical switch contacts operative upon the rotation of said re-usable electrical fuse through 180 degrees end-for-end into said second normal position.

6. A re-usable electrical fuse as defined in claim 5, and further comprising a non-electrically conductive tubular housing member and a conductive cylindrical terminal member capping each end of said housing member, said first and second circuit connector means each being in series connection with said automatically connecting means and said conductive cylindrical terminal members, and a sidewall opening in said tubular housing and in register with said first capsule for observing the end position of said charge of fusable metal therein.

7. A re-usable electrical fuse as defined in claim 6, wherein said automatically connecting means comprises a second elongated, non-electrically conductive, normally vertically-extending, hollow capsule, a third pair of electrical switch contacts extending inwardly of said second capsule at one end thereof, a fourth pair of electrical switch contacts extending inwardly of said capsule at other end thereof, a charge of metallic mercury within said second capsule and operative to fall to the lower end of said second capsule for close-circuiting the pair of electrical switch contacts thereat, said first fuse circuit connector means being series-connected with said fourth pair of electrical switch contacts, and said second fuse circuit connector means being connected in series with said third pair of electrical switch contacts.

8. A re-usable electrical fuse as defined in claim 7, wherein said first and second hollow capsules and said first and second fuse circuit connector means are enclosed within said tubular housing member and wherein the longitudinal axes of said first and second capsules are parallel with the longitudinal axis of said tubular housing member.

* * * * *